United States Patent [19]

Hutnak et al.

[11] Patent Number: 4,810,211

[45] Date of Patent: Mar. 7, 1989

[54] HEAD LEAD TERMINATOR

[75] Inventors: Robert A. Hutnak, Douglas; Stephen Finch, Groton, both of Mass.

[73] Assignee: Digital Equipment Corporation, Maynard, Mass.

[21] Appl. No.: 87,383

[22] Filed: Aug. 20, 1987

[51] Int. Cl.[4] ..... H01R 13/66

[52] U.S. Cl. ..... 439/620; 338/219; 361/403; 439/83

[58] Field of Search ..... 338/77, 219, 271; 361/392, 400, 403, 417, 419; 439/620, 83, 626, 629, 692, 694, 697

[56] References Cited

U.S. PATENT DOCUMENTS

| | | | |
|---|---|---|---|
| 3,375,481 | 3/1968 | Parnell | 439/694 |
| 3,622,949 | 11/1971 | Sorenson | 439/620 |
| 4,415,219 | 11/1983 | Kuhl et al. | 439/694 |
| 4,574,297 | 3/1986 | Ooi | 361/403 |
| 4,682,829 | 7/1987 | Kunkle et al. | 439/83 |

FOREIGN PATENT DOCUMENTS

| | | | |
|---|---|---|---|
| 2457248 | 7/1975 | Fed. Rep. of Germany | 439/620 |

*Primary Examiner*—Gary F. Paumen
*Attorney, Agent, or Firm*—Kenyon & Kenyon

[57] ABSTRACT

A read/write head lead assembly includes a terminator with a housing having a space adapted to receive a plurality of leads into which a plurality of electrically conductive contacts, each having a first portion within the space and a second portion extending from the housing to a location external the space, the second portions having contact surfaces in a common plane, to permit soldering to a preamplifier circuit board and a plurality of head leads with each of the head leads electrically connected with one of the contacts at a location within the space.

10 Claims, 2 Drawing Sheets

HEAD LEAD TERMINATOR

BACKGROUND OF THE INVENTION

The present invention relates to a terminator for connecting wires in an electrical circuit and, more particularly, to a head lead terminator for connecting read/-write head leads to a preamplifier circuit in a disc drive.

In a disc drive, read/write head leads are relatively small electrically conductive wires, typically having diameters of about 0.002 inches, and can therefore be easily damaged. For protection, head leads are normally encased in a protective tubing, for example, a teflon tubing. In the assembly of a disc drive actuator, it is necessary to connect the head leads, usually along with a damping resistor, to a preamplifier circuit.

One presently known method for attaching read/-write head leads to a preamplifier circuit is to individually hand-solder the head leads to solder pads on the preamplifier circuit board. The protective tubing around the head leads is then glued to the preamplifier circuit board to provide some added restraint to the dislodgement of the head leads. The head damping resistor, in this method, is soldered to pads on the preamplifier circuit board adjacent to the head lead solder pads.

A second known method for attaching head leads to a preamplifier circuit is to attach the head leads to a small flex circuit pad, e.g., 0.16 inch by 0.16 inch, and then attach the flex circuit pad to the preamplifier circuit board. In this method, the head damping resistor is also attached directly to the preamplifier circuit board by soldering to a solder pad on the board.

The space required for these methods of attaching the head leads to the preamplifier circuit board is so great that space has become a limiting factor for the number of head lead terminations possible in 5¼ inch disc drives.

It is therefore highly desirable to provide a device for connecting head leads, as well as head damping resistors, to preamplifier circuits in a manner which will reduce the area required to attach read/write head leads to preamplifier circuits, as well as provide added protection for the delicate head leads, thereby improving the reliability and allowing more consistency and higher quality of head lead connections.

SUMMARY OF THE INVENTION

The present invention provides a simpler and more reliable means for attaching wires in an electrical circuit, particularly for attaching head leads, as well as head damping resistors, to a preamplifier circuit in a disc drive by providing a head lead terminator. The terminator comprises a housing containing a plurality of electrically conductive contacts. The contacts are installed in the housing in a manner which provides access to the contacts both for attaching head leads and for attaching a damping resistor. Preferably, the contacts are accessible from both the upper and lower surfaces of the bottom of the housing for the attachment of head leads and, if desired, a head damping resistor, respectively. The housing is advantageously provided with a strain relief opening, e.g., a hole or slot, into which the protective tubing containing the head leads may be fastened with a suitable adhesive, such as a drop of glue. Upon insertion of the protective tubing with the head leads into the strain relief opening of the housing, the individual head leads may be soldered to the contacts at locations within the housing.

The contacts, which may be molded in the terminator housing, extend through the housing and thus have portions inside and outside the housing. The contact portions inside the housing provide electrical connection points for the head leads. The portions of the contacts outside the housing permit connection with the preamplifier circuit. The outside portions of the contacts can be of any suitable configuration such as Gull-wing or J-lead.

It will be appreciated that the head lead terminator of the present invention provides a means for electrically connecting head leads to a preamplifier circuit in a manner which will allow more consistent and higher quality termination of the head leads. The head lead terminator of the present invention advantageously reduces the area required to attach read/write head leads to preamplifier circuit boards. The present invention is designed to increase yields throughout the manufacture and test of disc drive actuator assemblies wherein fragile head leads are typically 0.002 inches in diameter and may be easily damaged. The present invention is further designed to reduce the read/write head lead test time by the head manufacturer and reduce the amount of labor required to assemble a disc drive actuator, thereby reducing overall costs.

DETAILED DESCRIPTION

Figure 1:
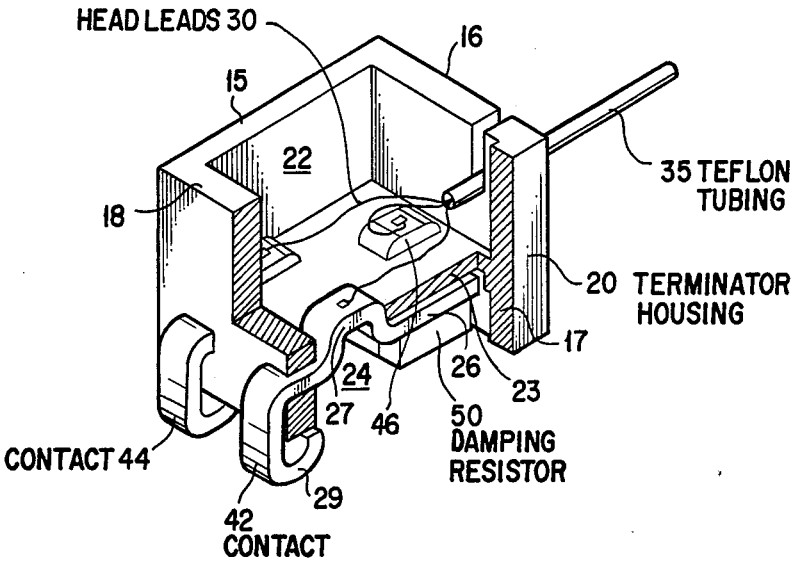
FIG. 1 shows a first embodiment of a head lead terminator assembly with sections removed, before potting.

The present invention provides a simpler and more secure means for attaching electrically conductive wires, particularly read/write head leads to a preamplifier circuit in a disc drive. In accordance with one embodiment of the present invention, as shown in FIG. 1, the head lead terminator 10 comprises a housing 20 formed from any suitable, electrically non-conductive, material, e.g., plastic. The housing includes two end walls 16 and 18 and two side walls 15 and 17, with wall 17 shown cut-away, to form a box-like structure. Intermediate the top and bottom of housing 20 is a horizontal divider wall 23. As a result, an upper enclosed space 22 and a lower enclosed space or recess 24 is formed. The upper space 21 of the terminator housing 20 is designed to receive head leads 30. To this end, end wall 16 is provided with a strain relief slot 25 through which a protective tubing 35, used to encase and protect fragile head leads 30, may be inserted. The strain relief slot 25 is preferably sized in a manner which will facilitate fastening the protective tubing 35 in the strain relief slot 25 with a small quantity of adhesive, such as a drop of glue.

Figure 2:
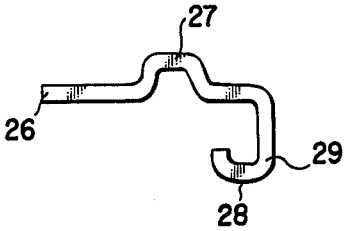
FIG. 2 is a side view of a J-lead contact used in the embodiment of FIG. 1.

Three contacts 42, 44, and 46 are provided. Contacts 42 and 44 extend out from end wall 18 and are formed into J-leads. Contact 46 similarly extends through end wall 16. Each contact has a portion 26 extending horizontally below divider 23. Formed in each portion 26 is a bump 27 which extends through divider wall 23. In this manner, each contact is accessible from both the upper space 22 and the lower space 24. Thus, with reference to FIG. 2, each J-lead contact has three portions: a flat portion 26, a raised portion or bump 27 and a curved portion 29. As explained above, this configuration advantageously provides ready access to each contact from both the upper space 22 and the lower space 24 when used in conjunction with the terminator housing 20, as shown in FIG. I.

The three head leads 30 are soldered respectively to the bumps 27 of contacts 40, 42 and 44. A termination resistor 50 is connected across contacts 42 and 44 by soldering it to the horizontal portions 26 in space 24.

The curved J-lead portions 29, which extend out the sides and curve around the bottom of the terminator housing 20, and have their bottom surfaces 28 (See FIG. 2) in a common plane are used for attachment of the terminator to a preamplifier circuit board (not shown) in conventional fashion.

While it will be appreciated that the housing 20 may be formed of any desirable material, in a preferred embodiment shown in FIG. 1, the housing 20 is formed of molded plastic having contacts 40, 42 and 44 molded therein.

Figure 3:
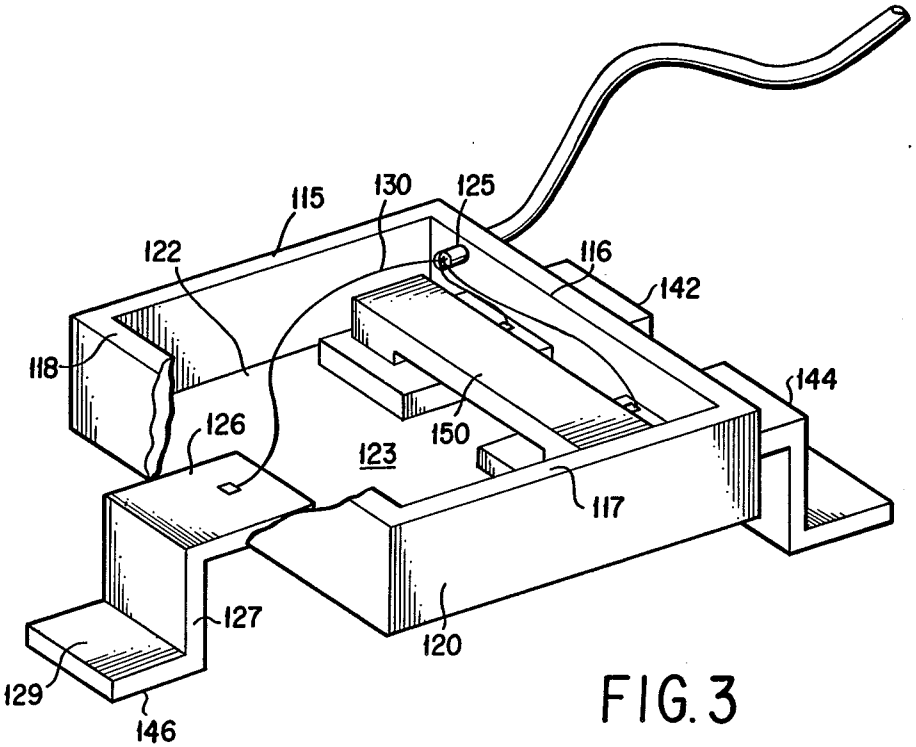
FIG. 3 shows a second embodiment of a head lead terminator assembly before potting, using Gull-wing contacts.

In an alternative embodiment of the present invention, illustrated in FIG. 3, terminator housing 120 comprises end walls 116 and 118, side walls 115 and 117 and a bottom wall 123 which forms a space 122 Which receives head leads 130 in a manner similar to that shown and described above with respect to FIG. 1. For strain relief, a hole 125 is formed in end wall 116. Contacts 142, 144, and 146 have horizontal portions 126 which extend through end walls 116 and 118 parallel to bottom wall 123 inside space 122 and are therefore readily accessible for attachment of head leads 130. The contacts 142, 144 and 146 shown in FIG. 3 are in a Gull-wing configuration. Thus, in addition to horizontal portions 126, they also have downwardly depending vertical portions 127 and horizontal outwardly extending portions 129 all in a common plane used for making contact with the preamplifier circuit board. In accordance with the embodiment of FIG. 3, a head damping resistor 150 is connected to contacts 142 and 144 at a location within housing chamber 122.

The head lead terminator of the present invention is preferably formed by molding a terminator housing of the type shown in FIG. 1 with three metal contacts molded in place in a manner which provides access to the contacts from both the upper and the lower surfaces. During assembly, the head lead protective tubing, e.g., teflon, is inserted in strain relief slot 25 in end wall 16 of the terminator housing and the individual head leads 30 are then soldered to the three contacts 42, 44 and 46 at a location inside the housing. The protective tubing is preferably fastened with a drop of adhesive. The soldering of the three contacts within the housing can be performed by a read/write head manufacturer who routinely deals with small diameter head lead wires. At this point in the manufacture of the head lead terminator, the head lead assembly is tested using the terminator as a means of signal connection during the test.

Head damping resistor 50 is then connected across contacts 42 and 44. After attachment of the head damping resistor, the space 22 within terminator housing 20 is then potted with a suitable potting material, thereby completing the assembly of the read/write head lead terminator.

The assembled head lead terminator 10 is then ready for attachment to a preamplifier circuit board using surface mount component soldering techniques which are highly preferably to the hand soldering of the individual head leads.

We claim:

1. A terminator for a plurality of small diameter leads comprising:

a housing forming a space adapted to receive a plurality of leads, said housing having a recess below said space;

a plurality of electrically conductive contacts each having a first portion within said space and a second portion extending from within said space to a location external to said housing, said second portions having contact surfaces in a common plane, said contact surfaces having a substantially planar portion adapted for soldering, whereby leads may be electrically fixed to said contacts which extend from said housing to permit said terminator and thus said leads to be attached to a printed circuit board; and a damping resistor electrically connected across two of said contacts and wherein said resistor is disposed within said recess.

2. A terminator according to claim 1 wherein said contacts include portions to permit connection of a resistor outside of said space.

3. A terminator according to claim 1 wherein said housing is made of plastic.

4. A terminator according to claim 1 and further including an opening in said housing to receive a tubing which surrounds said leads.

5. A read/write head lead assembly comprising:

a terminator including:

a housing forming a space adapted to receive a plurality of leads;

a plurality of electrically conductive contacts each having a first portion within said space and a second portion extending from within said space to a location external to said space, said second portions having contact surfaces in a common plane, said contact surfaces having a substantially planar portion adapted for soldering;

a plurality of head leads each of said head leads electrically connected with one of said contacts at a location within said space; and a damping resistor electrically connected across two of said contacts.

6. A read/write head lead assembly according to claim 5 and further including protective tubing surrounding said head leads and an opening in a wall of said housing through which said leads surrounded by said tubing pass, said tubing adhesively attached to said housing at said opening.

7. A read/write head lead assembly according to claim 5 wherein said resistor is disposed outside of said space.

8. A read/write head lead assembly according to claim 5 wherein said space is at least partially filled with a potting material.

9. A read/write head lead assembly according to claim 5 wherein said assembly comprises three head leads and three contacts.

10. A terminator according to claim 5 wherein said damping resistor is located within said space.

* * * * *